US005899405A

United States Patent [19]

Kruger et al.

[11] Patent Number: 5,899,405

[45] Date of Patent: May 4, 1999

[54] WINDING MACHINE FOR WINDING A TRAVELING WEB OF PAPER

[75] Inventors: Jens Kruger, Heidenheim; Jorg Maurer, Steinheim, both of Germany

[73] Assignee: Voith Sulzer Papiermaschinen GmbH, Germany

[21] Appl. No.: 08/880,964

[22] Filed: Jun. 23, 1997

[30] Foreign Application Priority Data

Jun. 21, 1996 [DE] Germany ..... 196 24 716

[51] Int. Cl.[6] ..... B65H 18/14

[52] U.S. Cl. ..... 242/541.4; 242/542

[58] Field of Search ..... 242/542, 542.1, 242/542.2, 527, 527.2, 541.4, 541.7, 541.5, 541.6, 908

[56] References Cited

U.S. PATENT DOCUMENTS

| | | |
|---|---|---|
| 3,346,209 | 10/1967 | Cronin . |
| 3,497,151 | 2/1970 | Voss . |
| 4,789,109 | 12/1988 | Kyytsonen et al. . |
| 5,222,679 | 6/1993 | Dropczynski et al. . |
| 5,478,026 | 12/1995 | Schonmeier et al. . |
| 5,492,287 | 2/1996 | Raudaskoski et al. . |
| 5,505,403 | 4/1996 | Raudaskoski . |
| 5,562,261 | 10/1996 | Beisswnager et al. . |
| 5,579,182 | 11/1996 | Raudaskoski . |
| 5,769,352 | 6/1998 | Biagiotti . |

FOREIGN PATENT DOCUMENTS

| | | | |
|---|---|---|---|
| 0631955 | 4/1995 | European Pat. Off. . | |
| 0496863 | 11/1995 | European Pat. Off. . | |
| 1047001 | 12/1958 | Germany | 242/541.7 |
| 4029914 | 3/1992 | Germany | 242/542 |
| 5070004 | 3/1993 | Japan | 242/542 |
| 092005099 | 4/1992 | WIPO | 242/542 |

*Primary Examiner*—Donald P. Walsh
*Assistant Examiner*—William A. Rivera
*Attorney, Agent, or Firm*—Ostrolenk, Faber, Gerb & Soffen, LLP

[57] ABSTRACT

The winding machine of the invention includes two parallel wound web roll support rollers which are spaced apart and on which the roll being wound is supported. The gap between the support rollers and below the supported wound roll is to be pressurized. A pressure chamber is defined by the support rollers, the wound roll above, and from below by a cross member which bridges over the distance between the support rollers and closes the bottom of the gap. End walls close the ends of the chamber. The cross member is movable between a sealing position where it is in contact with, or at least is sealed with, the two support rollers and bridges the gap between them to an open position where it opens the gap between the support rollers. The cross member is movable either down out of the gap, laterally out of the gap, or a combination of both, by reciprocating swinging, or oblique movement, and the like. The cross member has at least one passage which connects the pressure chamber with a source of compressed air through an intermediate conduit. An elongate transverse distributing pipe arranged at a distance from the cross member has a pressure connection through the conduit leading to the cross member.

18 Claims, 9 Drawing Sheets

Fig.4.1
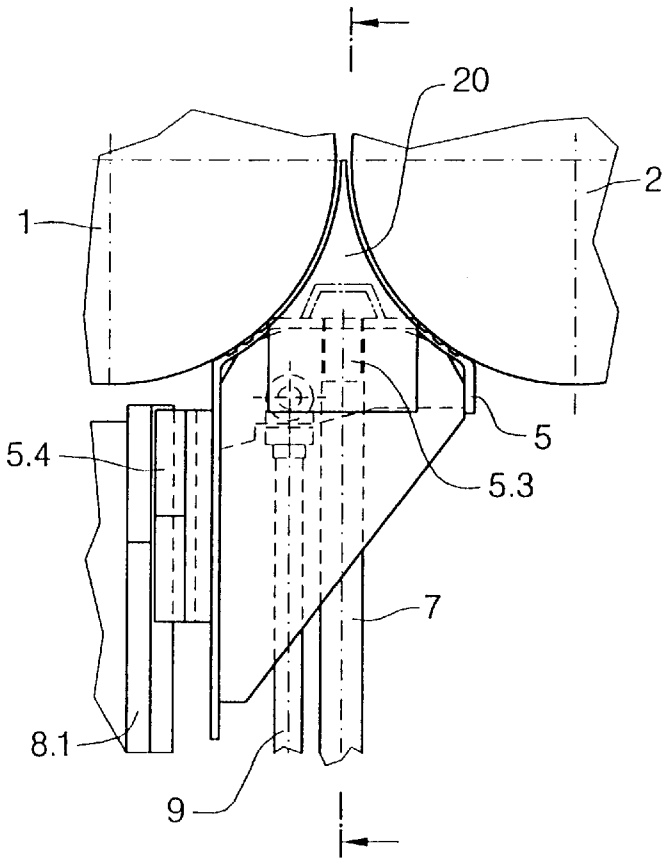
Fig.4.2
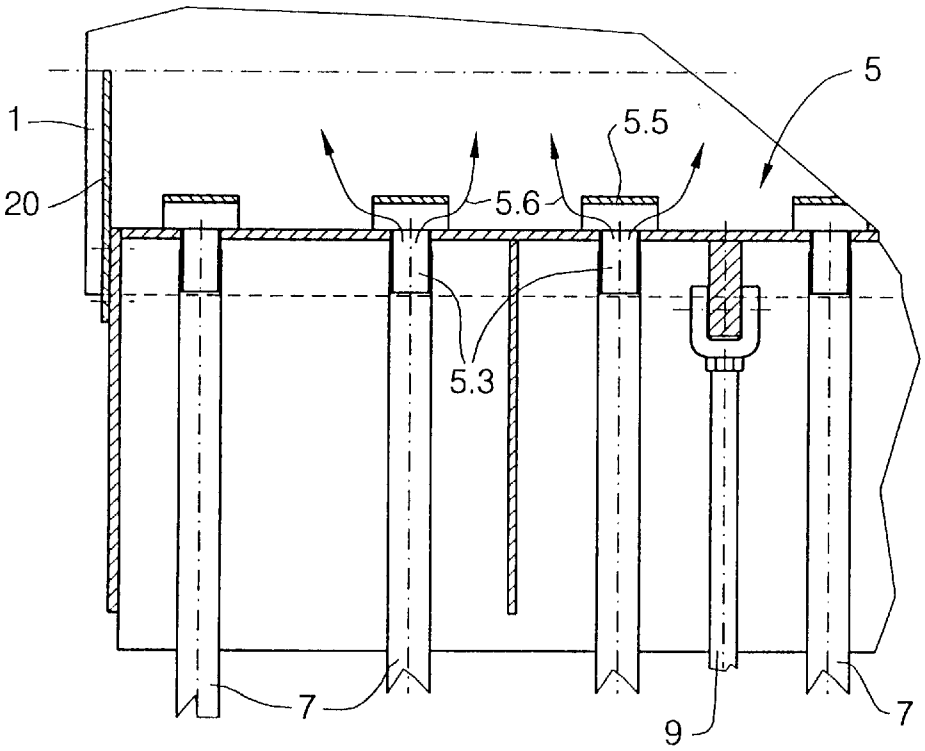

WINDING MACHINE FOR WINDING A TRAVELING WEB OF PAPER

BACKGROUND OF THE INVENTION

The present invention relates to a winding machine for winding a traveling web of paper.

Numerous designs of such machines are known. EP 0 496 863 B1 discloses a double support roller winding machine having the possibility of relieving the weight of the rolls of paper produced by compressed air. For this purpose, a pressure chamber is formed which is limited by the outer surface of the two support rollers that support the wound roll, by the outer surface of the resultant roll of paper, by displaceable end walls which are arranged at the respective end regions of the support rollers, as well as by a blow box which extends parallel to the support rollers and lies with greater or lesser sealing action against the outer surfaces of the support rollers. The blow box can be moved away from the support rollers in order, for instance, to remove pieces of paper after a paper jam or in order to swing a cutting knife from below into the slot between the support rollers during a change of rolls.

A machine in accordance with that reference may compensate for the weight of the paper roll or rolls themselves by the pressure in the pressure chamber. However, this has disadvantages. The blow box requires a relatively large amount of space since it generally extends to below the lowest points of the two support rollers. If the blow box is to be swung away from the two support rollers, space is also required for this. Since the blow box can, in general, be moved away only in a downward direction, and since a lift device necessary for this purpose usually acts on the bottom of the blow box, a correspondingly large amount of space must be provided below the machine. But this place frequently lacks space.

SUMMARY OF THE INVENTION

The object of the invention is to develop a support roll winding machine for winding a traveling web of paper, with compensation for the weight of the resultant or emerging roll using compressed air relief, such that less space than previously is required below the support rollers.

To achieve this object, the winding machine of the invention includes two parallel wound web roll support rollers which are spaced apart and on which the roll being wound is supported. The gap between the support rollers and below the supported wound roll is to be pressurized. A pressure chamber is defined by the support rollers, the wound roll above, and from below by a cross member which bridges over the distance between the support rollers and closes the bottom of the gap. End walls close the ends as well.

According to the invention, the cross member is movable between a sealing position where it is in contact with, or at least is sealed with, the two support rollers and bridges the gap between them to an open position where it opens the gap between the support rollers. The cross member is movable either down out of the gap, laterally out of the gap, or a combination of both, by reciprocating, swinging, or oblique movement, and the like.

The cross member has at least one passage which connects the pressure chamber with a source of compressed air through an intermediate conduit. An elongate transverse distributing pipe arranged at a distance from the cross member has a pressure connection through the conduit leading to the cross member.

To solve the problem of the invention, the inventors have proceeded along a path which differs fundamentally from EP 0 496 863 B1. Instead of that prior blow box, the invention uses a cross member for bridging over the distance between the two support rollers and thus for limiting the pressure chamber. Furthermore, compressed air is fed via a conduit, or (depending on the width the web) via a plurality of conduits distributed over the width of the web, through the cross member and into the pressure chamber.

As compared with the blow box of the prior art, the cross member has a much smaller cross section as seen in a sectional plane perpendicular to the axes of the support rollers. In the extreme case, the cross member merely comprises a plate, having two longitudinal edges which each form a seal with the corresponding support rollers. This plate presents no problem of space upon the cross member moving away, even if it is moved away downwardly. It is particularly helpful that the lift device can enter into action further toward the top than previously. The cross member can also be moved out toward the lateral side, i.e. parallel to the axes of the support rollers, or even perpendicular to those axes in a horizontal direction below one of the two support rollers. Swinging the cross member away is also possible. In that case, the cross member can remain at rest against the outer surface of one of the support rollers, and it therefore swings around an axis parallel to the support roller. However, an eccentric axis of swing can also be provided.

Particularly for winding machines for large width webs, an air pressure box may also be provided in the machine. This box is then, however, arranged at a distance from the cross member, for instance below one of the two support rollers. A plurality of conduits form a connection between the pressure box and the pressure chamber defined and bordered by the support rollers, the cross member, the wound roll of paper, and the laterally displaceable end walls. The compressed air box thus has the function of a transverse distributing pipe, with a corresponding number of streams of compressed air of, for instance, the same pressure and rate of flow being fed to the pressure chamber below the roll of paper.

One could say that the functions of the known blow box are divided between two components, the cross member, which now merely has the function of blocking off the pressure chamber below the paper roll which is being produced, and the transverse distributing pipe with the conduits, which together optimally feed and shape the streams of compressed air.

The transverse distributing pipe may be stationary, but this is not required. The conduits are advisedly hoses. The individual conduit can be telescopic. It can also be comprised of sections which are articulated to each other.

If the transverse distributing pipe is at least approximately as long as the working width of the machine, and if the individual conduits which connect the transverse distributing pipe with the pressure chamber are arranged uniformly over the length of the transverse distributing pipe, then distribution of the pressure over the working width will be optimal.

Other features and advantages of the present invention will become apparent from the following description of the invention which refers to the accompanying drawings.

BRIEF DESCRIPTION OF THE DRAWINGS

FIG. 4.1 shows a further embodiment;

FIG. 4.2 is a longitudinal section through FIG. 4.1;

DETAILED DESCRIPTION OF EMBODIMENTS OF THE INVENTION

Figure 1:
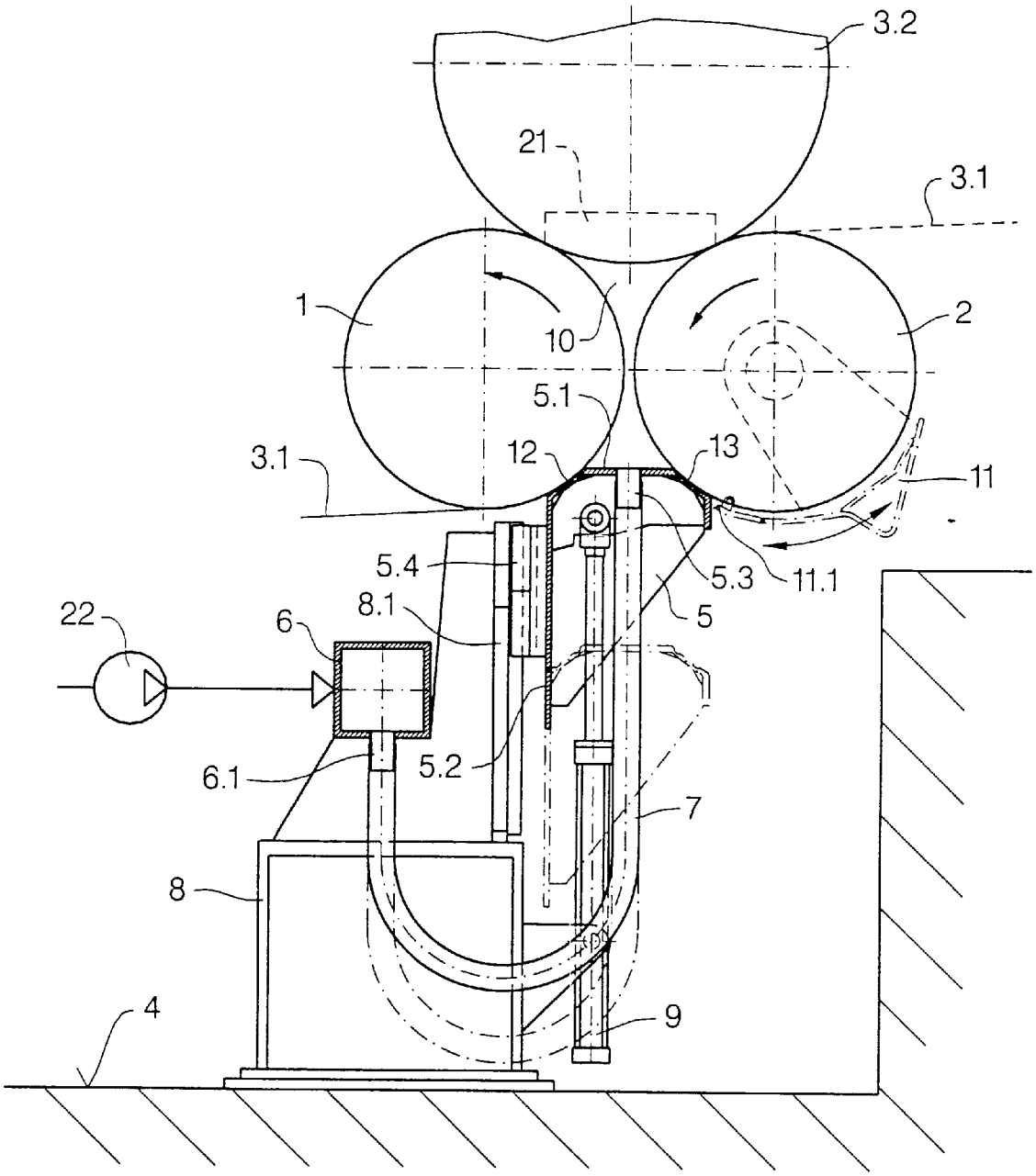
FIGS. 1–3 show side views of respective winding machine embodiments with respective arrangements of cross member, conduits, and transverse distributing pipe.

The support roller winding machine embodiment shown in FIG. 1 has two support rollers 1, 2. They serve for winding up a continuous web of paper 3.1 to form a roll of paper 3.2 and support the developing roll on themselves.

Below the two support rollers 1, 2 there is the machine basement with a floor 4.

The gap between the outer surfaces of the two support rollers 1, 2 has top and bottom openings, the top opening being bridged by the emerging roll and the bottom opening being bridged by a cross member 5 that extends across the gap, below the line joining the centers of the rollers, and extending downward. The cross member 5 has substantially the shape of an upside-down L with horizontal arm or plate 5.1 and vertical arm or plate 5.2.

There is a transverse distributing pipe 6 to which is connected a plurality of hoses or conduits 7, but only a single hose can be noted.

Cross member 5 and transverse distributing pipe 6 extend over substantially the entire working width of the machine, and at least over the minimum working width. They are thus at least approximately as long as the roll of paper 3.2, or the rolls of paper in a row if a lengthwise cutting device is present. The transverse distributing pipe 6 has a number of compressed air outlets 6.1 corresponding to the number of and connected to the hoses 7. The arm 5.1 of the cross member 5 is also provided with a corresponding number of passages, formed from compressed air connectors 5.3. One end of each hose 7 is connected to a connector 6.1 of the transverse distributing pipe 6 and the other end is connected to a compressed air connector 5.3 of the arm 5.1.

A frame 8 is fastened on the floor 4 of the basement. It supports the transverse distributing pipe 6 and a carriage 8.1. The carriage 8.1 includes a slide member 5.4 which acts on the vertical arm 5.2 of the cross member 5. Upon up and down reciprocating movement of the cross member 5, excellent vertical guidance is assured.

A spindle drive or a hydraulic or pneumatic drive 9 serves as an actuator for up and down movement of the cross member 5. Cross member 5 and hoses 7 are shown in two positions. In the upper, solid line position, the horizontal part 5.1 of the cross member 5 shuts off the pressure chamber 10 below the roll of paper 3.2. In the lower, dash-dot line position, this does not occur.

The winding machine of FIG. 1 also has a web cutting device 11. That device is swingable in the directions shown by the double ended arrow around the axis of the support roller 2. The cutting device is activated when the paper roll 3.2 has reached its full diameter and when the cross member 5 has been moved downward. Then the knife 11.1 of the cutting device 11 is moved upward through the space between the two support rollers 1, 2.

It is obvious that the pressure chamber 10 must, at least to a certain extent, be air tight in order for the compensating effect of the compressed air relief device to take place. For this purpose, seals 12, 13 are provided in the region of the longitudinal edges of the horizontal part 5.1. These may be sealing strips. However, labyrinth packings or the like can also be used, so that the sealing is not in contact with the support rollers.

As can be seen, the web of paper 3.1 is fed from the bottom left to the support roller 1 (solid line path) and thus wraps around it from the bottom to the top. However, it would also be possible to bring it onto the second support roller from the top right and pass it through the press nip and between the support roller 2 and the paper roll 3.2 (dashed line path). This path of the web avoids the danger of air from the pressure chamber 10 being wound in between the layers of paper of the paper roll 3.2. It would also have the advantage that neither of the two seals 12, 13 would have to be contactless. Rather, contacting seals could be provided between the longitudinal edges of the horizontal part 5.1 of the cross member 5 and the outer surfaces of the two support rollers 1, 2. The cutting device 11 would be replaced by a perforating device described further below.

Figure 2:
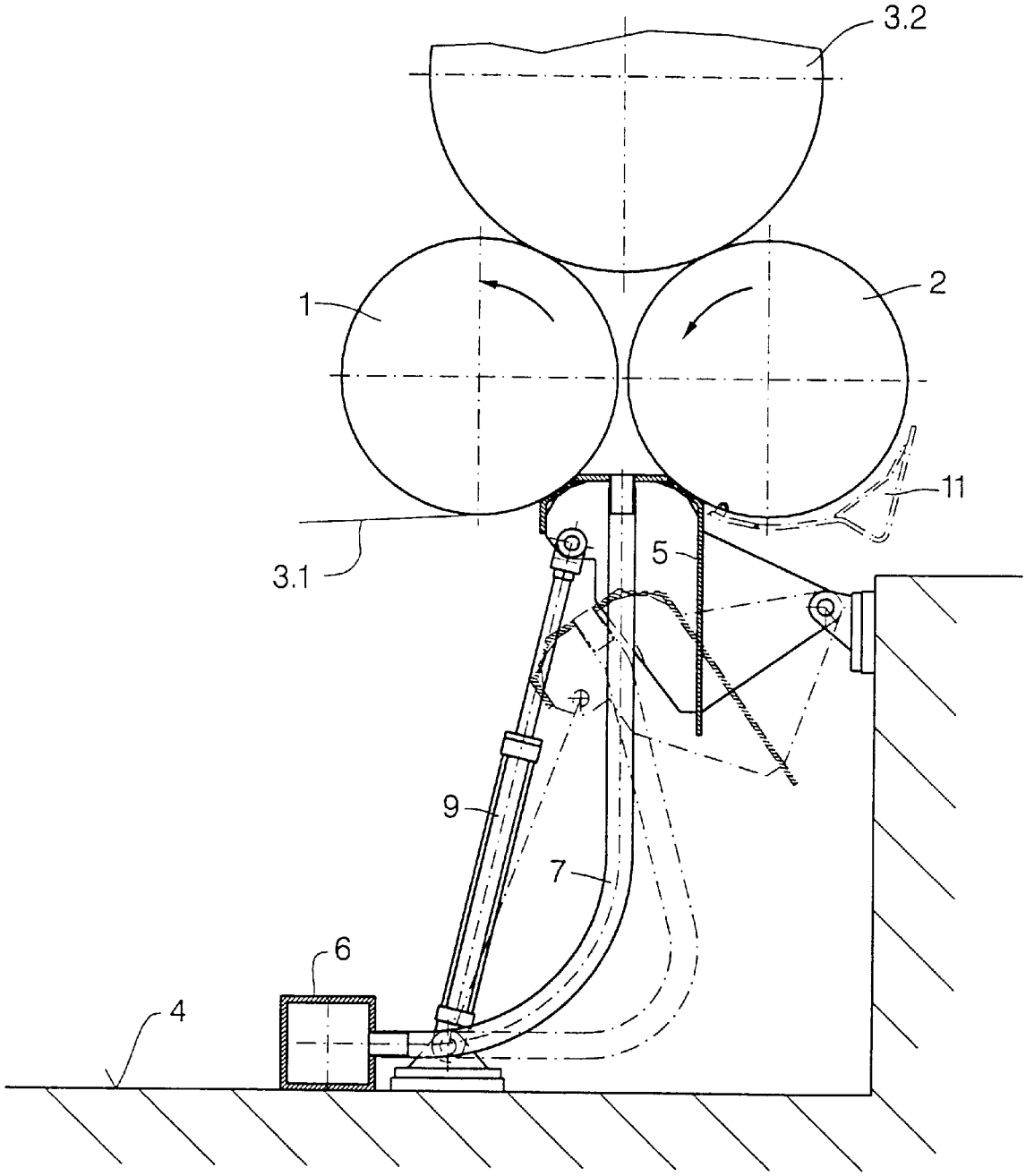

The embodiment in FIG. 2 differs from that of FIG. 1 particularly in the manner of displacement of the cross member 5. In FIG. 1, the cross member is movable vertically up and down, while in FIG. 2, it is swingable. The swung away position is shown in dash-dot line. The transverse distributing pipe 6 is arranged on the floor 4 of the basement. The pneumatic actuator 9 is also arranged differently than in the embodiment of FIG. 1. There are advantages in the arrangement shown in FIG. 2 with respect to the removal of paper waste, which could fall from above.

Figure 3:
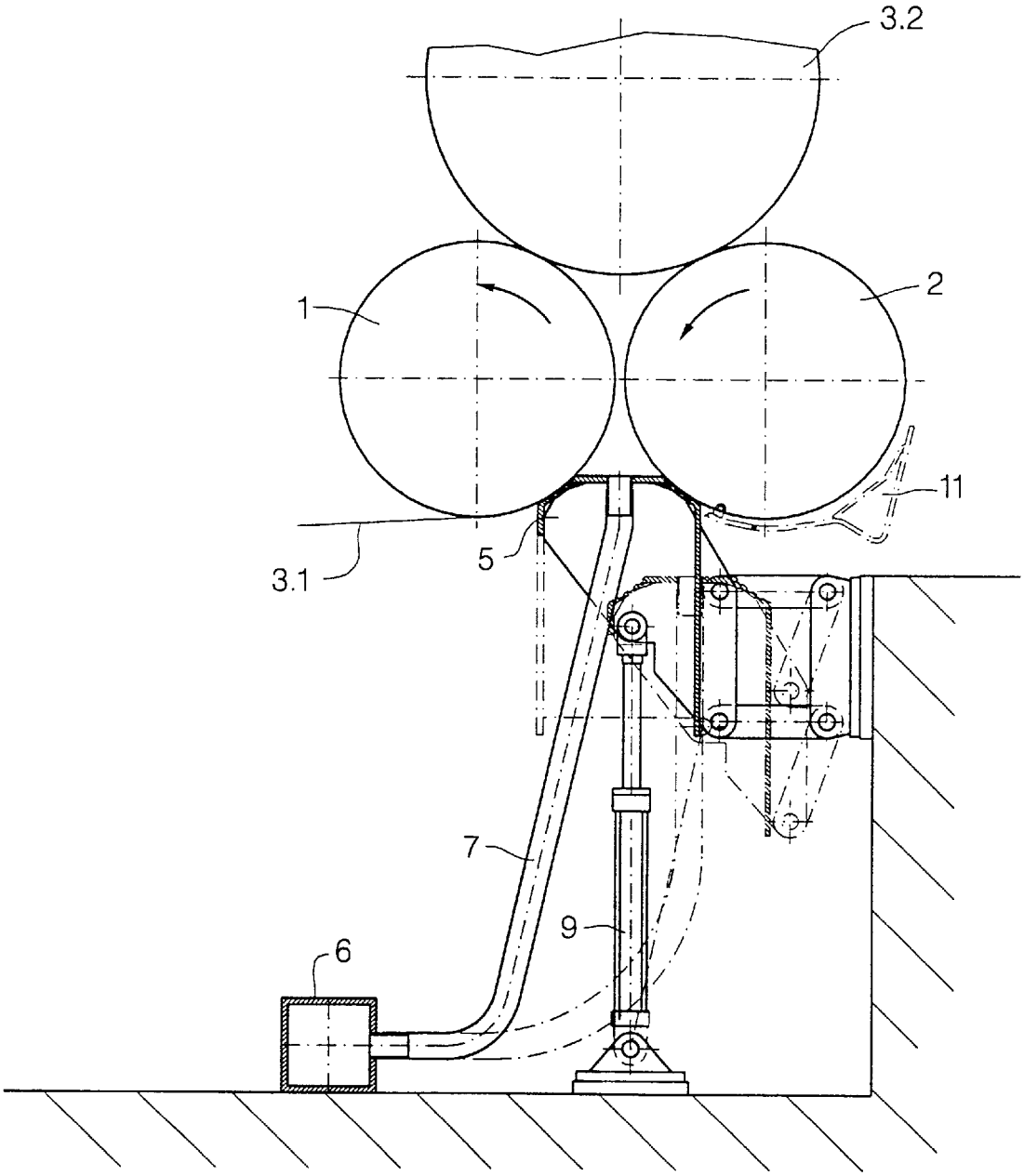

The embodiment of FIG. 3 is similar to that of FIG. 2. This embodiment also seeks to be able to clear a paper jam rapidly and easily. As indicated, the cross section of the cross member can be that of a U open toward the bottom, for instance, for reasons of stability. The pair of links shown supporting the cross member 5 retain its upright orientation while swinging the cross member to one side.

The embodiment shown in FIGS. 4.1 and 4.2 has a cross member 5 which is similar to that of FIG. 1. In this case also, a carriage guidance 5.4, 8.1 is provided for dependable vertical guidance of the cross member 5 by the pneumatic actuator 9. Cover caps 5.5 for the compressed air connectors 5.3 have a protective function, to prevent impurities entering the hoses 7. They also assure further equalizing of the streams of air, since each individual stream of air is divided and deflected in the manner indicated by arrows 5.6.

Figure 5:
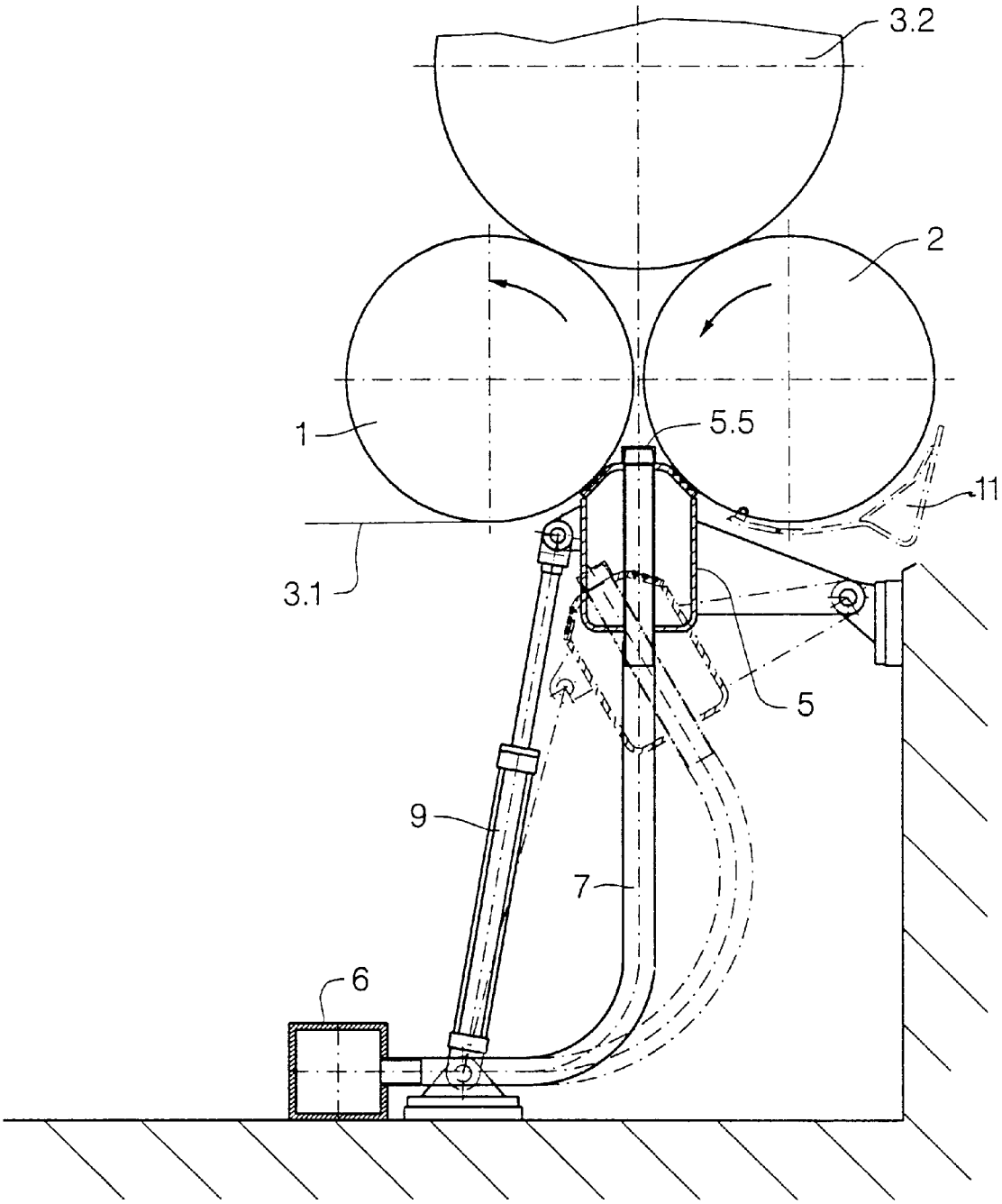
FIGS. 5–7 show side views of three further embodiments.

The embodiment of FIG. 5 is similar to that of FIG. 4 with respect to the arrangement and suspension of the cross member 5 as well as with respect to the arrangement of the transverse distributing pipe 6 and of the pneumatic actuator 9.

The cross member 5 is of box shape here. However, this is merely to stiffen the structure, because the cross member 5 takes up a relatively large part of the end of each conduit 7. Only the conduit parts present outside the cross member 5 are flexible.

Another variant of a cross member, described below with reference to FIG. 9, has substantially the following features. The cross member 5 supports a web cutting device 11 which is also movable relative to the supporting cross member and thus can be introduced in traditional manner vertically from below into the winding bed in order to cut the web upon a change of rolls.

In a further alternative, instead of a web cutting device 11 in accordance with German Applications 195 19 306.7 and 295 08 732.3, a perforating device can be provided, preferably in combination with an automatic web end gluing device. This has the advantage, for instance, in accordance with FIG. 6 or 8 that, in the development of the weight relief means, no consideration need be taken of a traditional web cutting device. In other words, the cross member need not be swung as far down, since there is no longer any danger of interference with the web cutting device. The cross member also need not serve as the support for a web cutting device.

Feeding compressed air via flexible conduits makes it possible to vary the volumetric flow over the width of the machine in a simple manner. For example, larger conduit cross sections can be provided in the edge zones in order to compensate for any leakage at the end seals.

In the case of a cross member which is open towards the bottom, the sealing strips can be screwed on from the inside of the cross member. The screws are in this way more readily accessible.

As compared with the traditional air box, there is much less danger of dirtying the air feed system. In particular, the penetration of paper residues into the air feed system can be at least extensively avoided by, for instance, providing the air outlet openings in accordance with FIG. 4.1, 4.2 or 5 with a cover 5.5.

The cross member of the invention can be of substantially less weight than a traditional air box, for instance, by the use of smaller thicknesses of plate, since the load produced by the pressure is substantially less.

The bottom side shields 20 which extend below the cross member can be fastened rigidly or movably to the cross member 5, as shown in FIGS. 4.1 and 4.2. However, they can also be supported insulated from that member. The top side shields 21 (FIG. 1) which are above the cross member and block the air chamber, as heretofore, are supported movably independently of the bottom side shields. In a further variant, the top side shields could be coupled to the bottom ones and guided axially together with them.

The transverse distributing pipe 6 in all cases is connected to a source of compressed air 22 (FIG. 1). It could be arranged at an end of the transverse distributing pipe. Furthermore, compressed air feed connectors at both ends are conceivable. Finally it is possible to provide one or more compressed air feed connectors on each longitudinal side.

Figure 6:
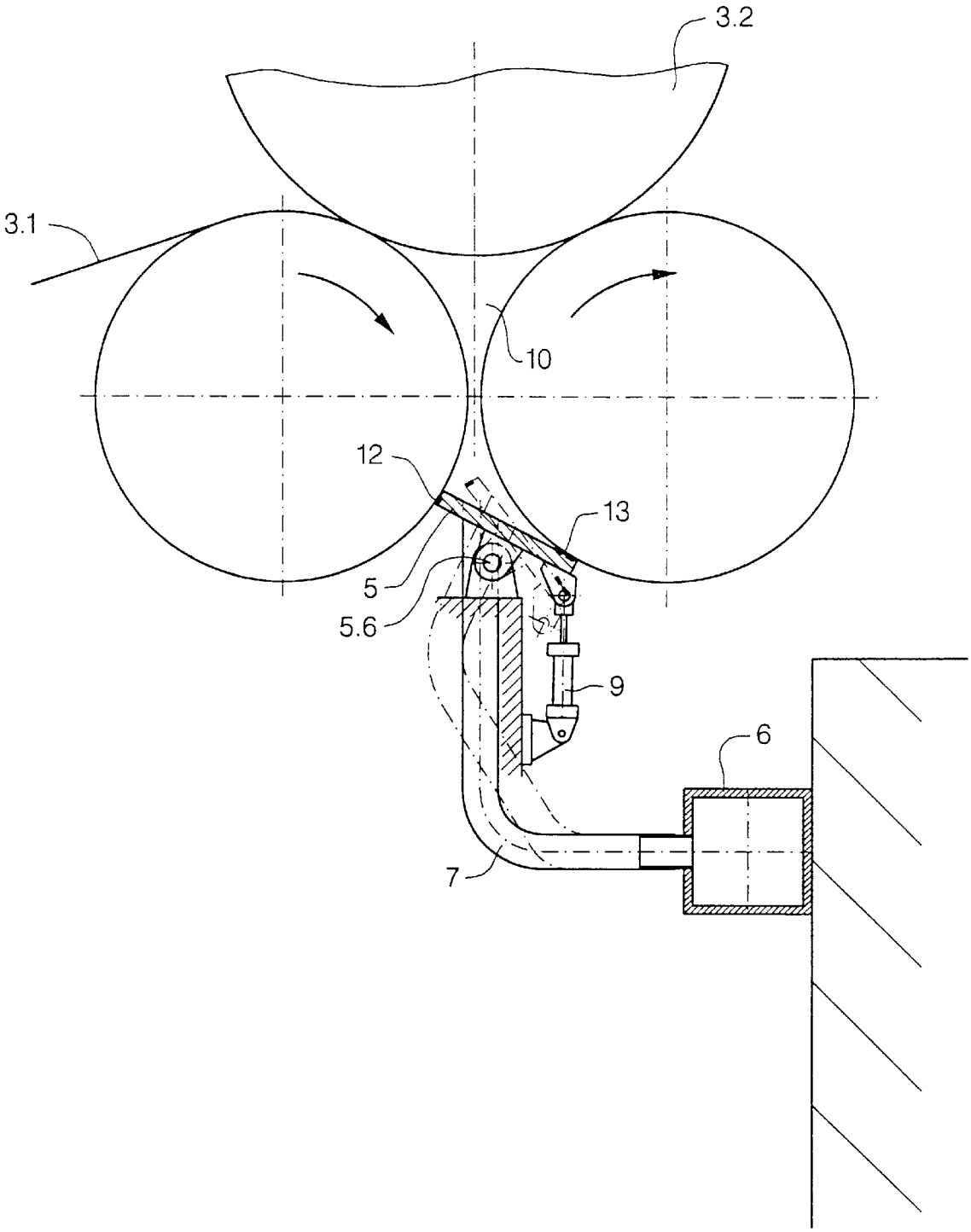

In the embodiment shown in FIG. 6, the paper web 3.1 is brought from above to the winding machine, i.e. into the press nip between the support roller 1 and the roll of paper 3.2 produced. In contrast to that embodiment in which the paper web 3.1 is introduced from below into the space between the support rollers 1 and 2, this embodiment has the great advantage that no air is forced between the individual layers of the paper roll 3.2 which is being produced.

In FIG. 6, a substantially plate shaped cross member 5 is swingable about an axis of swing 5.6. The axis of swing 5.6 extends parallel to the axes of the two support rollers 1, 2. A pneumatic drive 9 swings the cross member 5. In this case also, sealing strips 12, 13 which can rest with contact on the outer surfaces of the two support rollers 1, 2 are provided on the member 5 as indicated where they contact the rollers 1, 2.

The transverse distributing pipe 6 is connected to the pressure chamber 10 by a plurality of conduits through the cross member 5.

In the embodiment shown in FIG. 7, the paper web 3.1 is fed from below into the space between the two support rollers 1, 2. In this embodiment, as in FIG. 6, the cross member 5 is substantially plate shaped and is swingable around a fixed axis 5.6.

The transverse distributing pipe 6 can be fixed in place. The conduits 7 are rigidly connected to the transverse distributing pipe 6. As an alternative, transverse distributing pipes 6, conduits 7, and cross member 5 can, as shown in FIG. 7, form a rigid unit which is swingable around an axis of swing 6.3 of the transverse distributing pipe 6.

Figure 7:
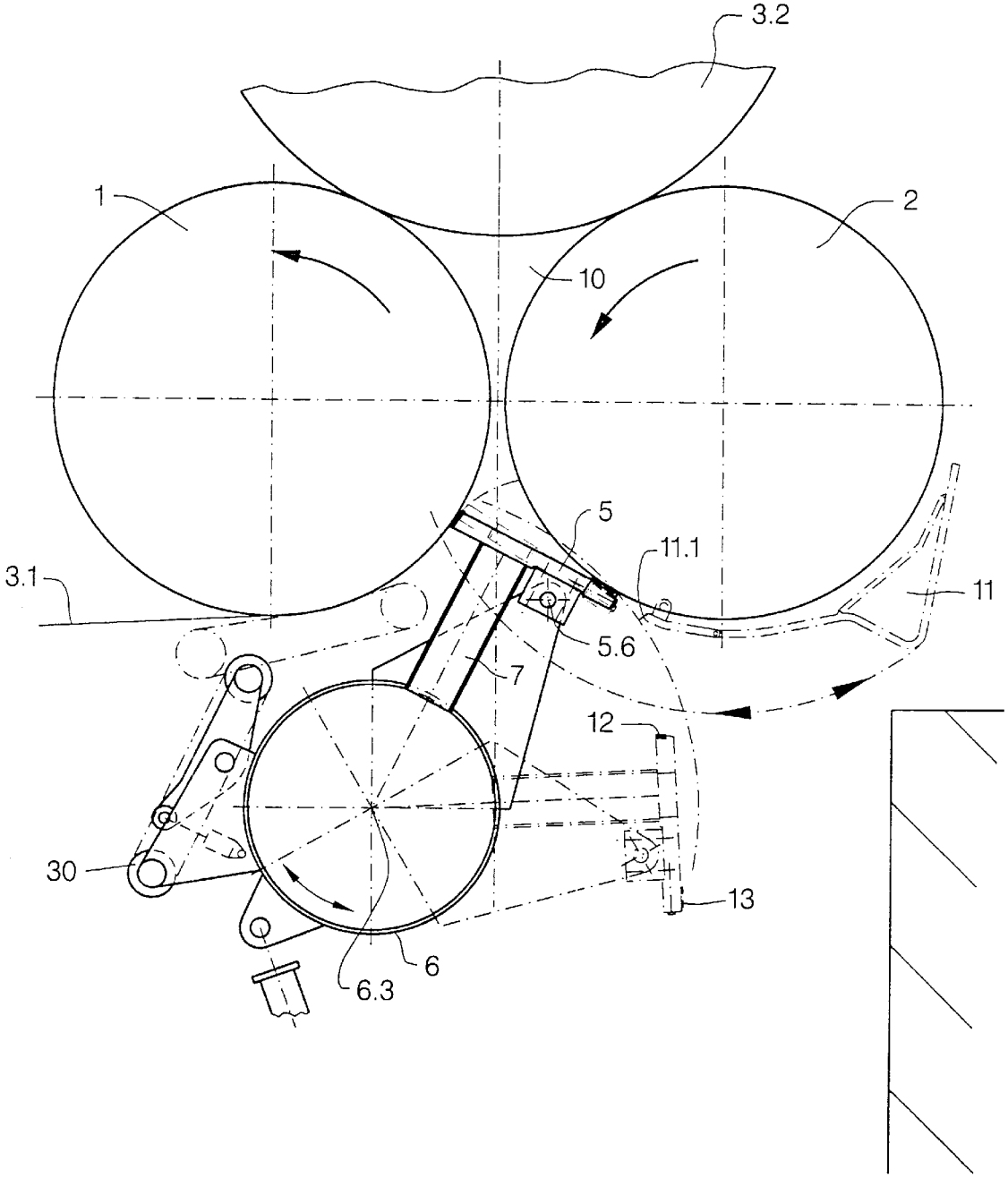

The cross member in FIG. 7 also supports a web introduction device. This device must be activated upon a change of rolls takes place at the unrolling station (from where the web of paper is delivered) and thus a new web end must be threaded into the winding machine.

A belt guide 30 introduces the web 3.1. The guide rests on the transverse distributing pipe 6. It enters into operating position (broken line) when the cross member 5 is moved out of its operating position (also broken line).

This embodiment of a winding machine also has a traditional cutting device with a knife 11.1, as shown in FIG. 1.

Figure 8:
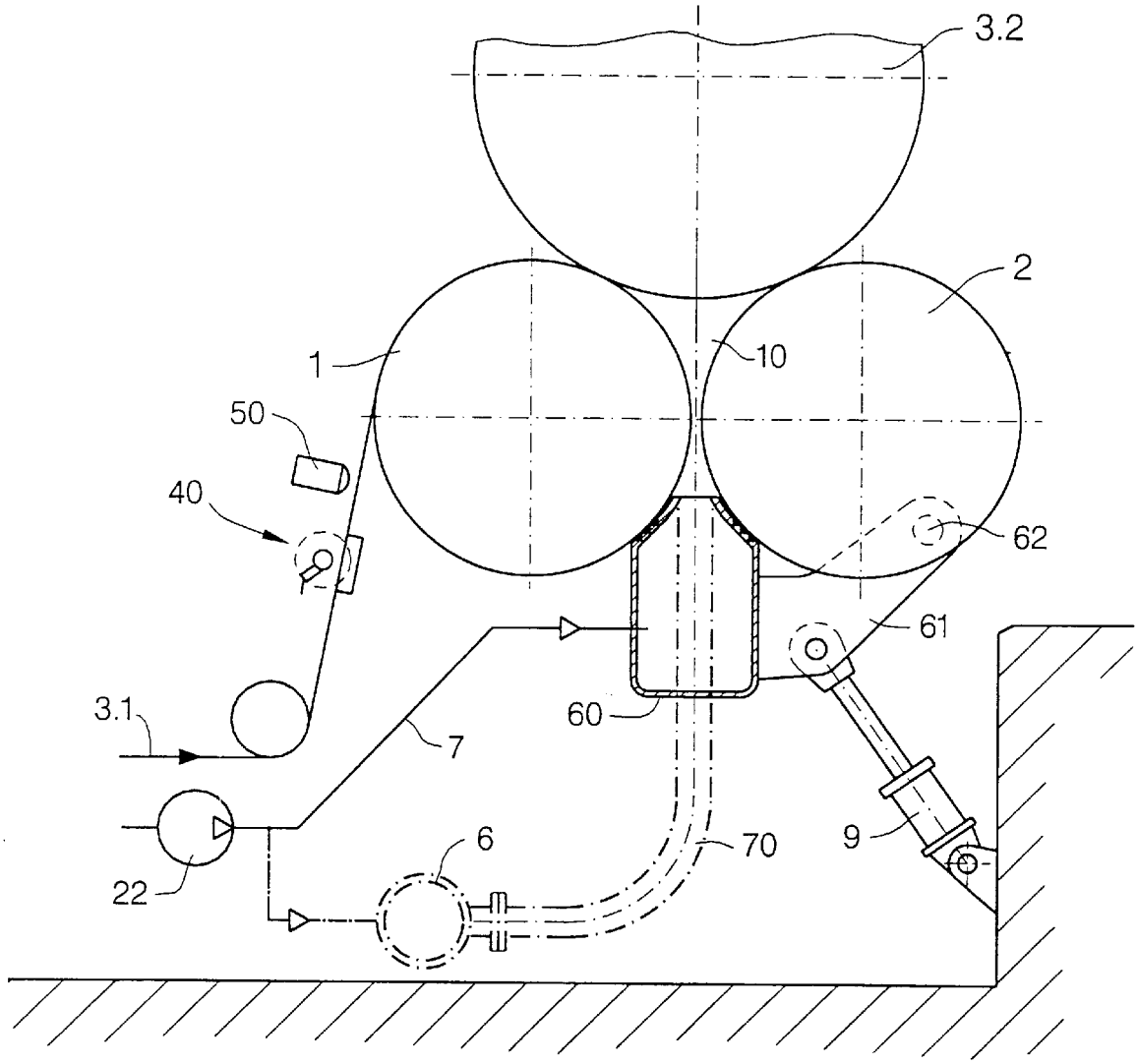
FIG. 8 is a side view showing an embodiment having a compressed-air box.

FIG. 8 shows another embodiment of a winding machine in which the paper web 3.1 is fed from above into the press nip between the support roller 1 and the paper roll 3.2 which is being produced. Upstream of the winding machine, there is a perforating device 40 and also several adhesive dispensers 50 distributed over the width of the web. For details of such devices, reference is had to German Patent Applications 195 19 306.7 and 295 08 732.9.

The winding machine operates with a compressed air or blow box 60. The latter can be moved in and out of the operating position shown here by a pneumatic drive 9. The blow box is swingable by swing levers 61 around an axis of swing 62.

A source of compressed air 22 is provided. It is in direct communication with the compressed air box 60 via one or more conduits 7.

Figure 9:
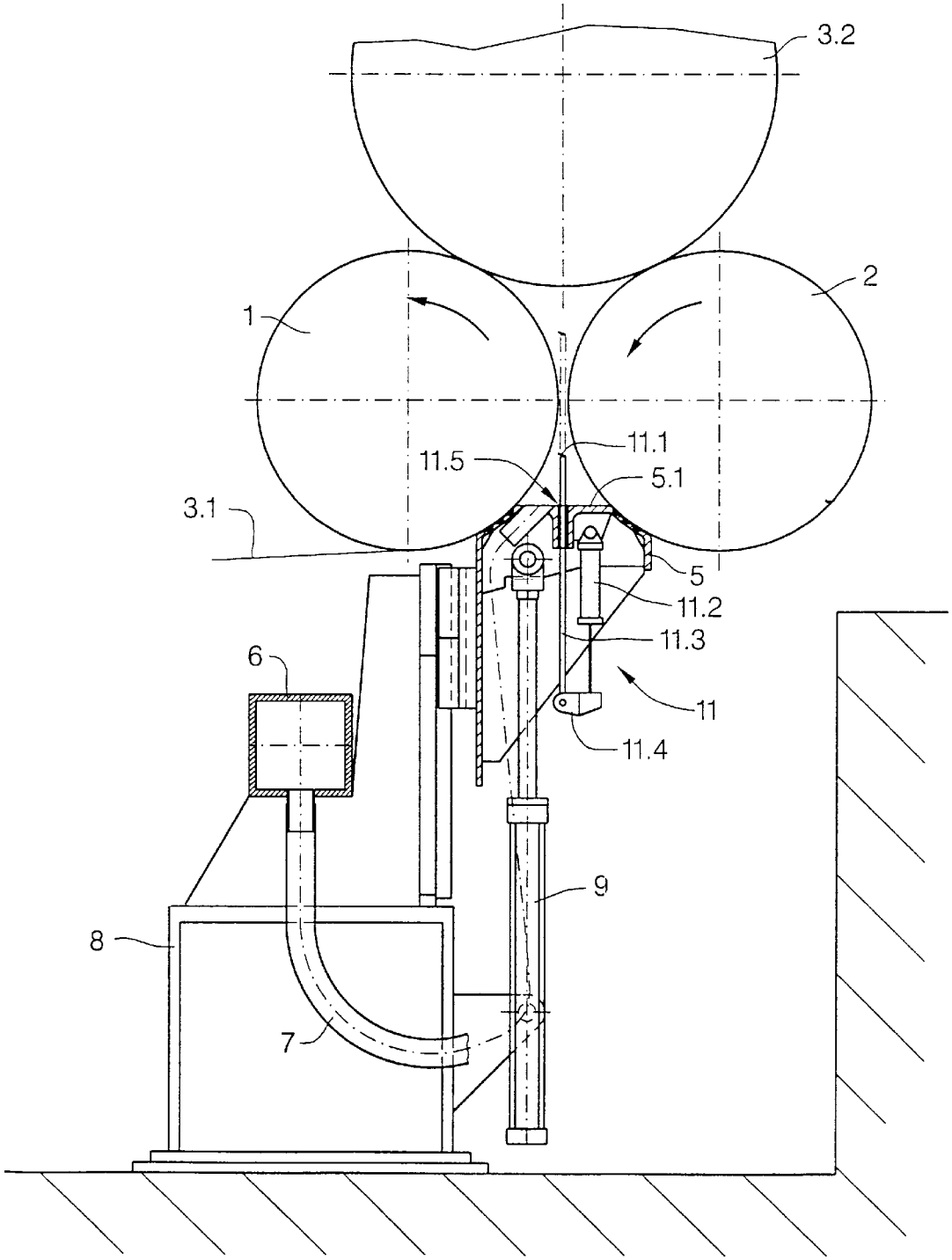
FIG. 9 is a side view of another embodiment having a cutting device of special development.

The winding machine of FIG. 9 is of very similar construction to that of FIG. 1. One difference lies in the web cutting device 11 and its arrangement with respect to the cross member 5. The web cutting device 11 is mounted on the cross member 5 so that it participates in the reciprocation of the cross member caused by the drive 9. The cutting device comprises a narrow supporting beam 11.3 for a knife 11.1 and it has a the drive 11.2 of its own. This drive may be pneumatic or hydraulic. The supporting beam 11.3 and drive 11.2 are mechanically connected by a link 11.4. Arm 5.1 of the cross member has an opening 11.5 through which the supporting beam 11.3 is passed and in which it can be moved up and down by means of the drive 11.2, between an inoperative position and an operative position (the latter shown in dot-dash line).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A winding machine for winding a traveling paper web, the winding machine comprising two support rollers arranged parallel, alongside each other and having outer surfaces spaced apart from each other a short distance defining a gap between them and close enough together to support a wound web roll on the support rollers;

a cross member positionable for bridging over the distance of the gap between the support rollers and for generally sealing with the support rollers;

a pressure chamber for being pressurized and being defined and surrounded by the outer surfaces of the support roller, the outer surface of the wound roll being wound and supported on the support rollers, the cross member positioned to bridge the distance between the support rollers and end walls at the end regions of the support rollers and blocking the ends of the gap;

a support for the cross member for moving the cross member between a position bridging over the distance between the support rollers and a position that opens the gap between the outer surfaces of the support rollers providing access into the gap from below;

a plurality of passages into the cross member arranged along the length of the support rollers and communicating into the gap between the support rollers, a respective conduit to each passage into the cross member; a source of compressed air for supplying compressed air to the cross member passages;

an elongated, transverse distributing pipe extending in the direction along the length of the support rollers and spaced away from the cross member, a connection into the distributing pipe for compressed air; each conduit being connected to the pipe for receiving compressed air, such that the distributing pipe can distribute the compressed air to the conduits; the transverse distributing pipe being supported on the machine separated from the cross member such that the distributing pipe does not move with the cross member and the support thereof.

2. The winding machine of claim 1, wherein each of the conduits is telescopable to change its length, particularly as the cross member moves.

3. The winding machine of claim 1, wherein each of the conduits is comprised of sections articulated to each other for enabling the conduit to adjust to the movement of the cross member with reference to the distributing pipe.

4. The winding machine of claim 1, wherein each of the conduits is flexible to accommodate movement of the cross member with reference to the transverse distributing pipe.

5. The winding machine of claim 1, wherein the cross member is removable from the winding machine without removal of the transverse distribution pipe.

6. The winding machine of claim 1, further comprising the cross member being swingably supported on a swing axis extending parallel to the support rollers, the axis being located so that the cross member selectively swings to bridge the gap between the support rollers or to open the gap between the support rollers and the transverse distribution pipe being supported on the machine so as to not be swingable with the cross member.

7. The winding machine of claim 1, wherein the cross member comprises a flat plate bridging the gap between the support rollers, the air pressure conduits communicating through the flat plate.

8. The winding machine of claim 1, wherein the cross member comprises a profiled beam shaped to be generally open in its profile downward but to be a closed beam across the gap between the support rollers.

9. The winding machine of claim 1, wherein the cross member comprises a hollow beam and the conduits are rigidly attached in the hollow beam.

10. The winding machine of claim 1, further comprising means delivering the web of paper from below to partially wrap one of the support rollers and to conduct the web upwardly to the wound roll.

11. The winding machine of claim 1, further comprising means for introducing the web into the winding machine through a nip between one of the support rollers and the wound roll being supported on the support rollers the web being directed to wind on the wound roll.

12. The winding machine of claim 11, further comprising a perforating device provided in front of the nip between one of the support rollers and the wound roll being produced.

13. The winding machine of claim 12, further comprising an adhesive dispenser provided in front of the nip and following the perforating device along the path of the web.

14. The winding machine of claim 1, further comprising a web cutting device positioned and operable for being introduced from below the gap between the support rollers to a position where the cutting device can cut the web.

15. The winding machine of claim 14, wherein the cutting device is positioned and operable for being blocked from entering the gap to cut the web when the cross member bridges the gap between the support rollers, and the cutting device being movable into the gap between the support rollers upon the cross member being moved away from the gap between the support rollers.

16. The winding machine of claim 14, wherein the cutting device is mounted on the cross member.

17. The winding machine of claim 16, further comprising an opening in the cross member, the cutting device includes a knife support beam, a knife supported on the beam therefor the knife being movable through the opening in the cross member by movement of the supporting beam between an operative position for the knife and a non-operative position for the knife.

18. A winding machine for winding a traveling paper web, the winding machine comprising two support rollers arranged parallel, alongside each other and having outer surfaces spaced apart from each other a short distance defining a gap between them and close enough together to support a wound web roller on the support rollers;

a cross member positionable for bridging over the distance of the gap between the support rollers and for generally sealing with the support rollers;

a pressure chamber for being pressurized and being defined and surrounded by the outer surfaces of the support rollers, the outer surface of the wound roll being wound and supported on the support rollers, the cross member positioned to bridge the distance between the support rollers, and end walls at the end regions of the support rollers blocking the ends of the gap;

a support for the cross member for moving the cross member between a position bridging over the distance between the support rollers and a position that opens the gap between the outer surfaces of the support rollers providing access into the gap from below;

at least one passage into the cross member, a conduit to each passage into the cross member and which is connectable to a source of compressed air for supplying compressed air to the cross member passage and the cross member passage communicating into the gap between the support rollers, and a shielding cap at the outlet from the passage into the gap, the cap being positioned and shaped for shielding the passage from entry of dirt but permitting the passage of the stream of air at the passage past the cross member into the pressure chamber.

* * * * *